US011828519B2

(12) United States Patent
Jiang et al.

(10) Patent No.: US 11,828,519 B2
(45) Date of Patent: Nov. 28, 2023

(54) REFRIGERATOR

(71) Applicants: GUANGDONG MIDEA WHITE HOME APPLIANCE TECHNOLOGY INNOVATION CENTER CO., LTD., Foshan (CN); MIDEA GROUP CO., LTD., Foshan (CN)

(72) Inventors: Chenzhong Jiang, Foshan (CN); Bao Yue, Foshan (CN); Hiroshi Omori, Foshan (CN)

( * ) Notice: Subject to any disclaimer, the term of this patent is extended or adjusted under 35 U.S.C. 154(b) by 456 days.

(21) Appl. No.: 17/271,183

(22) PCT Filed: Sep. 4, 2018

(86) PCT No.: PCT/CN2018/104015
§ 371 (c)(1),
(2) Date: Feb. 24, 2021

(87) PCT Pub. No.: WO2020/047755
PCT Pub. Date: Mar. 12, 2020

(65) Prior Publication Data

US 2021/0333037 A1 Oct. 28, 2021

(51) Int. Cl.
*F25D 17/06* (2006.01)
*F25D 23/02* (2006.01)

(52) U.S. Cl.
CPC ..... *F25D 17/065* (2013.01); *F25D 23/028* (2013.01)

(58) Field of Classification Search
CPC .... F25D 17/065; F25D 23/028; F25D 17/045; F25D 25/025; F25D 2317/04111;
(Continued)

(56) References Cited

U.S. PATENT DOCUMENTS

2007/0107457 A1 5/2007 Morris
2017/0261249 A1* 9/2017 Chen ..... F25D 23/12
2018/0093814 A1 4/2018 Espinosa

FOREIGN PATENT DOCUMENTS

CN 1802542 7/2006
CN 2844805 Y 12/2006
(Continued)

OTHER PUBLICATIONS

Second OA of Chinese Application No. 201880040146.5.
(Continued)

*Primary Examiner* — Lionel Nouketcha
(74) *Attorney, Agent, or Firm* — KILPATRICK TOWNSEND & STOCKTON, LLP

(57) ABSTRACT

Provided is a refrigerator, including a freezer compartment, a refrigeration compartment, a drying compartment, an air intake channel, a first sealing apparatus, and a second sealing apparatus. The drying compartment is independently provided within the refrigeration compartment in a sealed manner. The drying compartment is provided with an air inlet and an air outlet. The first sealing apparatus is provided in the drying compartment and can switch between sealing an air outlet of the air intake channel and leaving the air outlet of the air intake channel open. The second sealing apparatus is provided at the air outlet and can switch between sealing the air outlet and leaving the air outlet open. Cooled air in the freezer compartment is introduced into the drying compartment and then mixed with air in the drying compartment, a rise in the temperature of the cooled air allows the relative humidity in the drying compartment to be reduced.

15 Claims, 3 Drawing Sheets

(58) Field of Classification Search
CPC ..... F25D 2317/063; F25D 2317/0666; F25D 2317/0681; F25D 2400/02; F25D 17/042
See application file for complete search history.

(56) References Cited

FOREIGN PATENT DOCUMENTS

| | | | | | |
|---|---|---|---|---|---|
| CN | 102494464 | A | | 6/2012 | |
| CN | 202420079 | U | * | 9/2012 | |
| CN | 202420079 | U | | 9/2012 | |
| CN | 103557657 | A | | 2/2014 | |
| CN | 104344633 | A | | 2/2015 | |
| CN | 104567188 | A | | 4/2015 | |
| CN | 204902362 | U | | 12/2015 | |
| CN | 105806003 | A | | 7/2016 | |
| CN | 106016934 | A | | 10/2016 | |
| CN | 106895636 | A | | 6/2017 | |
| CN | 206458866 | U | | 9/2017 | |
| CN | 107477948 | A | | 12/2017 | |
| CN | 107806734 | A | | 3/2018 | |
| CN | 113494806 | A | | 10/2021 | |
| FR | 2454068 | A1 | | 11/1980 | |
| JP | 2008032392 | A | | 2/2008 | |
| JP | 2009287817 | A | | 12/2009 | |
| JP | 2017141977 | A | | 8/2017 | |
| JP | 6593158 | B2 | | 10/2019 | |
| KR | 20090089258 | A | | 8/2009 | |
| KR | 20090121263 | A | | 11/2009 | |
| KR | 101462671 | B1 | | 11/2014 | |
| KR | 20160099222 | A | | 8/2016 | |
| KR | 101827683 | B1 | | 2/2018 | |
| WO | 2016049974 | A1 | | 4/2016 | |
| WO | WO-2016049974 | A1 | * | 4/2016 | ..... F25D 11/02 |
| WO | 2016082534 | A1 | | 6/2016 | |
| WO | WO-2016082534 | A1 | * | 6/2016 | ..... F25D 11/02 |

OTHER PUBLICATIONS

The extended European Search Report of EP Application No. 18932916.2.
First Office Action dated Oct. 11, 2022 regarding the EP counterpart 18932916.2.
The First OA for CN Application No. 201880040146.5.
International Search Report of PCT/CN2018/104015.
Written Opinion of ISA regarding PCT/CN2018/104015.
Notice of Allowance dated Mar. 22, 2022 regarding the CN counterpart 201880040146.5.

* cited by examiner

REFRIGERATOR

CROSS-REFERENCES TO RELATED APPLICATIONS

The present disclosure is a national phase application of International Application No. PCT/CN2018/104015 filed on Sep. 4, 2018, the entireties of which are herein incorporated by reference.

FIELD

The disclosure relates to the field of refrigerator, and particularly to a refrigerator with a drying compartment.

BACKGROUND

At present, most refrigerators still do not have the function of regulating and controlling humidity. The humidity in the refrigerator fluctuates greatly, and the relative humidity (RH) generally fluctuates between RH 90% to RH 30%. For dry goods which are sensitive to humidity and need to be stored in the refrigerator, such as dried fruits, biscuits, and medicinal materials, if they are placed in the refrigerator compartment, they will easily get damp. If said dry goods are placed in the freezer compartment, the dry and low-temperature environment of the freezer compartment causes the dry goods to be in an extremely low temperature environment, and thus the dry goods is not suitable to be eaten directly when taken out of the refrigerator. In addition, the fluctuation range of the humidity is extremely wide when the compressor in the freezer compartment starts or stops.

SUMMARY

In view of this, an embodiment of the disclosure is intended to provide a refrigerator with a drying compartment.

Therefore, in order to achieve the above objective, an embodiment of the disclosure provides a refrigerator including a freezer compartment, a refrigeration compartment, a drying compartment, an air intake channel, a first sealing device, and a second sealing device. The drying compartment is independently and hermetically arranged in the refrigeration compartment and is formed with an air inlet and an air outlet for communicating the drying compartment with the refrigeration compartment. The air intake channel is used to communicate the freezer compartment with the drying compartment and passes through the air inlet. The first sealing device is arranged in the drying compartment and is configured to be switched between a state in which an outlet of the air intake channel is sealed by the first sealing device and a state in which the first sealing device keeps away from the outlet of the air intake channel. The second sealing device is arranged at the air outlet and is configured to be switched between a state in which the air outlet is sealed by the second sealing device and a state in which the second sealing device keeps away from the air outlet.

In an embodiment, the refrigerator includes an air guiding device. The air guiding device is arranged on the air intake channel to guide the air in the freezer compartment to the drying compartment.

In an embodiment, the first sealing device includes a first baffle and a first elastic member. The first baffle is adapted to the outlet of the air intake channel and covers the outlet of the air intake channel from one side of the drying compartment. The first baffle is connected with the first elastic member to seal against the outlet of the air intake channel under the action of an elastic force of the first elastic member.

In an embodiment, the first sealing device includes a first mounting seat and a guide post located in the first mounting seat. A receiving chamber is formed inside the first mounting seat and has an opening facing toward the outlet of the air intake channel. The first baffle and the first elastic member are received in the receiving chamber. The first elastic member is sandwiched between the first mounting seat and a side of the first baffle away from the outlet of the air intake channel.

The guide post is fixedly installed in the first mounting seat and is slidably connected with the first baffle; or the guide post is fixedly connected with the first baffle, the guide post and the first baffle is slidably in the first mounting seat.

In an embodiment, the refrigerator includes a second mounting seat arranged in the drying compartment and sandwiched between a side wall of the drying compartment and the first mounting seat. A through aperture is formed in the second mounting seat. An inlet end of the through aperture is hermetically connected with the air inlet. An outlet end of the through aperture is formed as the outlet of the air intake channel. The air guiding device is arranged in the through aperture.

In an embodiment, a protuberance is formed on a side of the second mounting seat facing toward the first mounting seat and extends into the first mounting seat. A plurality of first ribs is formed inside the protuberance. The ends of the plurality of first ribs form and surround a first supporting hole. Both ends of the guide post are slidably supported on the first supporting hole and the first mounting seat; or the guide post is fixedly connected with at least one of the first supporting hole and the first mounting seat, and the first baffle is slidably arranged around the guide post.

In an embodiment, a partition is formed between the freezer compartment and the refrigeration compartment and is formed with a through hole through which the air intake channel passes. The through hole is arranged corresponding to the air inlet. The air guiding device is arranged in the through hole.

In an embodiment, the outlet of the air intake channel is formed as the air inlet which forms a plurality of second ribs. The ends of the plurality of second ribs form and surround a second supporting hole. The guide post is fixedly connected with at least one of the second ribs and first mounting seat, and the first baffle is slidably arranged around the guide post; or both ends of the guide post are slidably supported in the second supporting hole and the first mounting seat, and the first baffle is fixedly connected with the guide post.

In an embodiment, the air guiding device is formed as a fan, a blower or an air pump.

In an embodiment, a partition is formed between the freezer compartment and the refrigeration compartment and is formed with a through hole through which the air intake channel passes. The through hole is arranged corresponding to the air inlet. The air guiding device is formed as an air pump which is arranged in the drying compartment. A first sealing device is formed as a self-sealing structure inside the air pump. An air inflow end of the air bump is hermetically connected with the air inlet.

In an embodiment, the refrigerator includes a damper arranged at the inlet of the air intake channel and operatively associated with the air guiding device.

In an embodiment, the second sealing device includes a second baffle and a second elastic member. The second baffle covers the air outlet from one side of the refrigeration compartment and is connected with the second elastic member to seal against the air outlet under the action of an elastic force of the second elastic member.

In an embodiment, the air outlet is formed at a top of the drying compartment. The second sealing device includes a third baffle which covers the air outlet from one side of the refrigeration compartment and seals against the air outlet under the action of gravity.

In an embodiment, the refrigerator further includes a heating element arranged in the drying compartment.

In an embodiment, the heating power of the heating element is less than 20 watts.

In an embodiment, the heating element is a resistance wire or a PTC heater.

According to the refrigerator of the embodiment of the disclosure, the cold air in the freezer compartment enters into the drying compartment and mixes with the air in the drying compartment. As such, the temperature of the cold air increases so that the relative humidity in the drying compartment decreases, realizing the low-temperature dehumidification and drying function in the drying compartment. Furthermore, the outlet of the air intake channel is selectively closed on the inside of the drying compartment by the first sealing device, so that the first sealing device does not affect the drawing operation of the drying compartment and ensures that the drying compartment is kept in a sealed environment when cold air does not need to be introduced. Therefore, moisture in the refrigeration compartment is prevented from flowing back into the drying compartment from the air inlet, and the cold air is prevented from entering into the drying compartment.

LIST OF REFERENCE NUMERALS

10: partition; 101: through hole; 11: freezer compartment; 12: drying compartment; 12*a*: air inlet; 12*b*: air outlet; 121: second rib;

13: refrigeration compartment; 121*a*: second supporting hole;

21: first mounting seat; 21*a*: receiving chamber; 22: first baffle;

23: first elastic member; 24: guide post; 25: damper; 40: air guiding device;

30: second sealing device; 50: second mounting seat; 50*a*: through aperture;

51: protuberance; 52: first rib; 52*a*: first supporting hole; 60: heating element;

120: side wall of the drying compartment.

DETAILED DESCRIPTION OF THE DISCLOSURE

In the following description, the words such as "in", "out", "top", and "bottom" should be understood with reference to the structure of the refrigerator of the disclosure.

Figure 1:
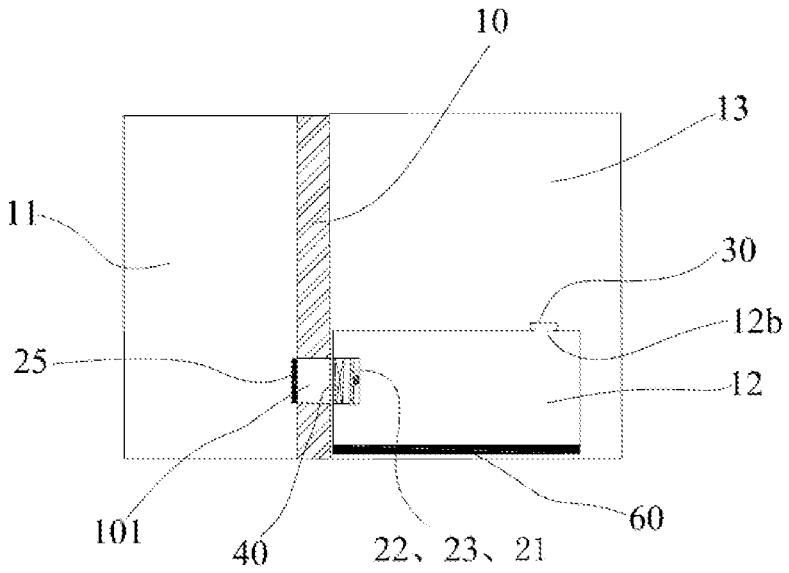
FIG. 1 is a simplified schematic view of the refrigerator according to the first embodiment of the disclosure, in which the air guiding device is located in the drying compartment.
Figure 5:
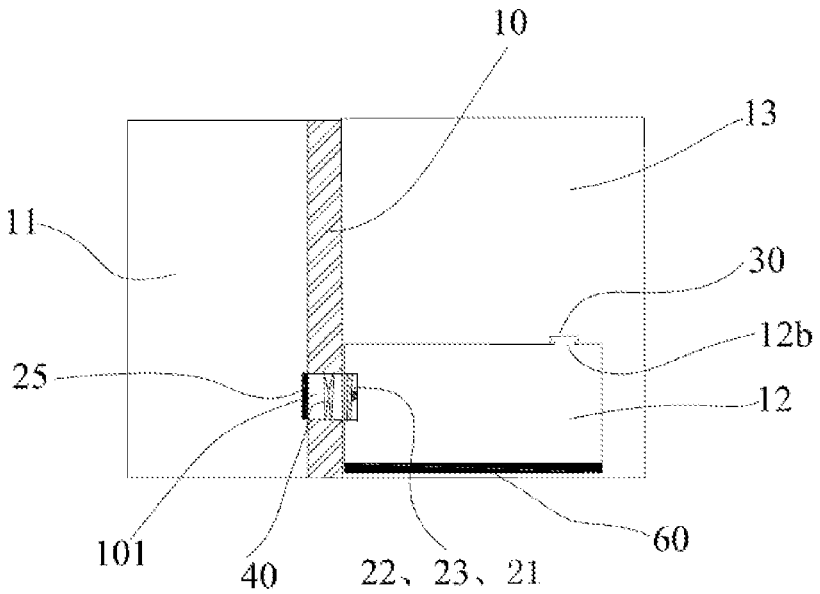
FIG. 5 is a simplified schematic view of a refrigerator according to a second embodiment of the disclosure, in which the air guiding device is located in the through hole of the partition.

An embodiment of the disclosure provides a refrigerator, referring to FIG. 1 and FIG. 5, which includes a freezer compartment 11, a refrigerator compartment 13, a drying compartment 12, an air intake channel, an air guiding device 40, a first sealing device and a second sealing device 30. Herein, the drying compartment 12 is independently and hermetically arranged in the refrigeration compartment 13 and is formed with an air inlet 12*a* (refer to FIG. 2 and FIG. 6) and an air outlet 12*b* for communicating the drying compartment 12 with the refrigeration compartment 13, that is, the air in the drying compartment 12 enters into the refrigeration compartment 13 through the air outlet 12*b*. The inlet of the air intake channel is located on the side of the freezer compartment 11; the air outlet is located on the side of the drying compartment 12, and the air intake channel passes through the air inlet 12*a*. In one embodiment, the freezer compartment 11 and the refrigeration compartment 13 are arranged adjacent to each other. A partition 10 is arranged between the freezer compartment 11 and the refrigeration compartment 13 and is formed with a through hole 101 through which the air intake channel passes. The through hole 101 is arranged corresponding to the air inlet 12*a* of the drying compartment 12. The first sealing device is located in the drying compartment and is arranged corresponding to the outlet of the air intake channel. In one embodiment, the first sealing device is configured to be switched between a state in which the outlet of the air intake channel is sealed by the first sealing device and a state in which the first sealing device keeps away from the outlet of the air intake channel. The second sealing device 30 is arranged at the air outlet 12*b* and is configured to be switched between a state in which the air outlet 12*b* is sealed by the second sealing device and a state in which the second sealing device keeps away from the air outlet 12*b* (i.e. the air outlet is not sealed). The cold air is guided from the freezer compartment 11 to the drying compartment 12 when the drying compartment 12 needs to be dehumidified. At this time, the first sealing device is in a position and the first sealing device keeps away from the outlet of the air intake channel; the second sealing device 30 is in a position and the second sealing device keeps away from the air outlet 12*b*; and the cold air in the freezer compartment 11 enters into the drying compartment 12 through the air intake channel. Generally, the temperature of the cold air of the freezer compartment 11 is about −18° C.; the temperature in the refrigeration compartment 13 is about 5° C.; and the temperature in the drying compartment 12 is relatively close to the temperature in the refrigeration compartment 13. The cold air mixes with the air in the drying compartment 12 after the cold air enters into the drying compartment 12, and the temperature thereof rises to about 5° C. The increase in the temperature of the cold air reduces the relative humidity in the drying compartment 12, so that the low-temperature dehumidification and drying function in the drying compartment 12 is realized, which is beneficial to the preservation of dry foods. The air intake channel is sealed from the inside of the drying compartment 12 by the first sealing device, and the air outlet 12*b* is sealed by the second sealing device, when the cold air does not need to be guided into the drying compartment 12. Thus, the drying compartment 12 forms a closed space to prevent the moisture in the refrigeration compartment 13 backflow to the inside of the drying compartment 12, affecting the humidity in the drying compartment 12. Generally, the drying compartment 12 is in form of a drawer-type structure and needs to be pulled out by the user during normal use. The drying compartment 12 should be designed in a way not affecting the pulling action of the drying compartment 12. Thus, there is a gap between the side wall of the drying compartment 12 and the side wall 120 of the refrigeration compartment 13. In the refrigerator according to the embodiment of the disclosure, the outlet of the air intake channel is selectively closed on the inside of the drying compartment 12 by the first sealing device, which ensures that the drawing action of the drying compartment 12 is not affected and an closed environment is maintained when the cold air is not required to be introduced. On the one hand, the closed environment prevents the moisture in the refrigeration compartment 13 from flowing back into the drying compartment 12 from the air inlet 12*a*; on the other hand, it can also prevent the cold air from entering into the drying compartment 12, to ensure that the humidity in the drying compartment 12 is kept within a suitable predetermined range, that is, the humidity is stable.

Figure 2:
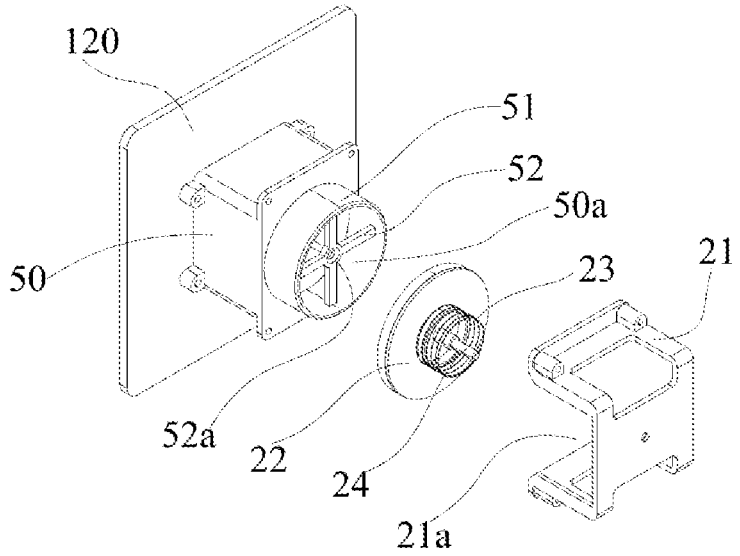
FIG. 2 is an exploded schematic view of the air guiding device and the first sealing device of the refrigerator according to the first embodiment of the disclosure.
Figure 3:
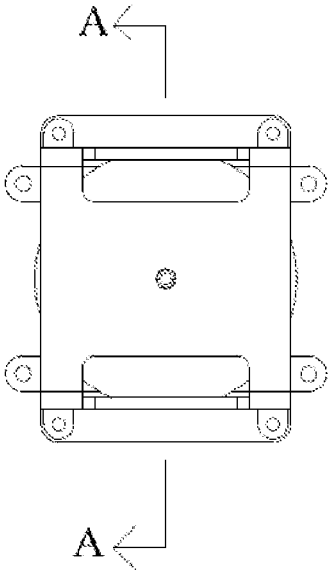
FIG. 3 is a front view of FIG. 2, and the end of the first mounting seat is orientated towards outside of the paper.
Figure 6:
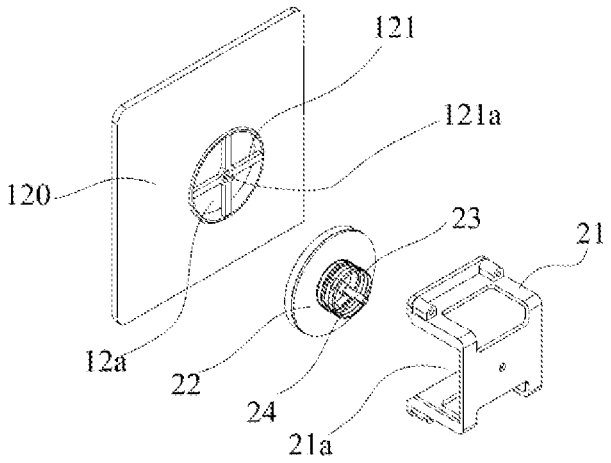
FIG. 6 is an exploded schematic view of the first sealing device of the refrigerator according to the second embodiment of the disclosure.

Referring to FIG. 2 and FIG. 6, the first sealing device includes a first baffle 22 and a first elastic member 23. The first baffle 22 is adapted to the outlet of the air intake channel and covers the outlet of the air intake channel from one side of the drying compartment 12. The first baffle 22 is connected with the first elastic member 23 to seal against the outlet of the air intake channel under the action of an elastic force of the first elastic member 23. When the cold air enters into the drying compartment 12 from the freezer compartment 11, an air pressure of the cold air pushes the first baffle 22 open against the elastic force of the first elastic member 23. At this time, the first baffle 22 keeps away from the air intake channel, so that the cold air can smoothly enter into the drying compartment 12 through the outlet of the air intake channel. When there is no cold air flowing through the air intake channel, the first baffle 22 is automatically reset under the action of the elastic force of the first elastic member 23 to cover the outlet of the air intake channel, so that the first baffle 22 is in the position for sealing the outlet of the air intake channel. The first baffle 22 of the embodiment of the disclosure can be automatically opened and closed without electrical control, and has high operational reliability. In addition, thanks to the structure of the first baffle 22 and the first elastic member 23, a positive pressure (the air pressure inside the drying compartment is higher than the air pressure outside the drying compartment) is maintained in the drying compartment 12 to prevent the air flow outside the drying compartment 12 from entering into the drying compartment 12.

In order to facilitate the installation of the first baffle 22 and the first elastic member 23, referring to FIG. 2 and FIG. 6, the first sealing device further includes a first mounting seat 21 and a guide post 24 located in the first mounting seat 21. The first mounting seat 21 is fixedly connected with the side wall of the drying compartment 12. It can be understood that the first mounting seat 21 may be fixedly connected with the side wall of the drying compartment 12 directly, or may be fixedly connected with the side wall of the drying compartment 12 indirectly by other components. A receiving chamber 21*a* is formed inside the first mounting seat 21 and has an opening facing toward the outlet of the air intake channel. The first baffle 22 and the first elastic member 23 are received in the receiving chamber 21*a*. The first elastic member 23 is sandwiched between the bottom of the receiving chamber 21*a* of the first mounting seat 21 and a side of the first baffle away from the outlet of the air intake channel. The first mounting seat 21 can provide a better protection for the first baffle 22 and the first elastic member 23, and prevents other objects stored in the drying compartment 12 from touching the first baffle 22 and the first elastic member 23, which ensures the operational reliability of the first baffle 22 and the first elastic member 23.

Figure 4:
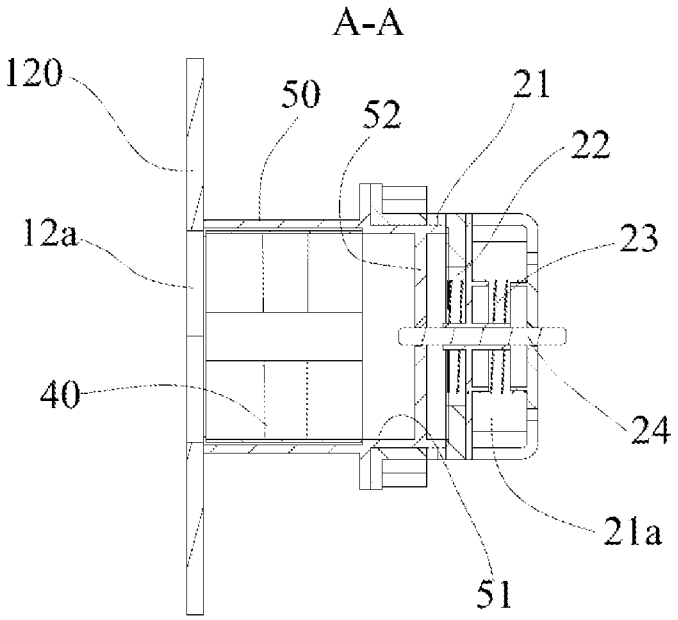
FIG. 4 is a cross-sectional view along the A-A direction of FIG. 3.

In the illustrated embodiment of the disclosure, referring to FIG. 4 and FIG. 6, the guide post 24 is fixedly installed in the first mounting seat 21. It can be understood that one end of the guide post 24 may be fixedly connected to the first mounting seat 21 and the other end is a free end; alternatively, one end of the guide post 24 is directly or indirectly fixedly connected with the side wall of the drying compartment 12, and the other end is a free end; alternatively, one end of the guide post 24 is directly or indirectly fixedly connected with the side wall of the drying compartment 12, and the other end is fixedly connected with the first mounting seat 21. The first baffle 22 is slidably connected with the guide post 24, that is, the first baffle 22 can slide along the length of the guide post 24 under the action of the first elastic member 23, and the guide post 24 has a good guiding effect on the movement of the first baffle 22 to improve the operational reliability of the first baffle 22.

In an embodiment not shown, the guide post 24 is fixedly connected with the first baffle 22, the guide post 24 and the first baffle 22 is slidable in the first mounting seat 21. In one embodiment, one end of the guide post 24 is slidably supported on the end of the first mounting seat 21, and the other end of the guide post 24 is slidably supported on the side wall of the drying compartment 12 or slidably supported on a component fixedly connected with the side wall of the drying compartment 12. In this way, the guide post 24 drives the first baffle 22 to slide in the first mounting seat 21.

The air guiding device 40 is arranged on the air intake channel to guide the air in the freezer compartment 11 to the drying compartment 12, that is, an air flow is forcibly formed between the freezer compartment 11 and the drying compartment 12 by the air intake device to efficiently and actively guide the cold air in the freezer compartment 11 to the drying compartment 12, so that the drying compartment 12 can be rapidly dehumidified within 3 to 5 minutes to meet the requirement of rapid dehumidification of the drying compartment 12.

The air guiding device 40 may be arranged in the drying compartment 12, or may be arranged in the interval between the refrigeration compartment 13 and the freezer compartment 11, or may be arranged in the freezer compartment 11.

In an embodiment, referring to FIG. 1 and FIG. 5, the first sealing device further includes a damper 25 arranged at the inlet of the air intake channel and operatively associated with the air guiding device 40. That is, the damper 25 is opened when the air guiding device 40 is opened, and the damper 25 is closed when the air guiding device 40 is closed. In one embodiment, when one side of the through hole 101 of the partition 10 located at the freezer compartment 11 forms the inlet of the air intake channel, the damper 25 can be arranged at the through hole 101. The damper 25 is closed following the close of the air guiding device 40. During the drying compartment 12 is sealed, the damper 25 can prevent the first baffle 22 from accidentally opening by disturbance of the air flow on the side of the freezer compartment 11, to ensure the stability of the humidity inside the drying compartment 12. Therefore, according to the refrigerator of the embodiment of the disclosure, the damper 25 and the first baffle 22 have a double sealing protection function for the air intake channel to ensure the sealing reliability in the drying compartment 12. It can be understood that the size of the opening of the damper 25 can be adjusted, so that the air flow rate of the cold air entering the drying compartment 12 can be adjusted.

The position of the air outlet 12*b* is not limited, and it can be arranged on the top or side of the drying compartment. It can be understood that the relationship between the position of the air outlet 12*b* and the position of the outlet of the air intake channel should ensures that the air flow discharged from the outlet of the air intake channel and the air in the drying compartment 12 are mixed sufficiently and then discharged from the air outlet 12*b*, so that the air flow in the drying compartment 12 is replaced at maximum capacity.

The second sealing device includes a second baffle (not shown) and a second elastic member (not shown). The second baffle covers the air outlet 12*b* from one side of the refrigeration compartment 13 and is connected with the second elastic member to seal against the air outlet 12*b* under the action of an elastic force of the second elastic member. The second baffle and the second elastic member can adopt the structure of the first baffle 22 and the first elastic member 23 mentioned above, or is formed as a spring door structure. The sealing principle and working process of the second baffle and the second elastic member are similar to the sealing principle and working process of the first baffle 22 and the first elastic member 23 mentioned above, and will not be repeated here.

In another embodiment not shown, the refrigerator includes a third baffle (not shown). When the air outlet 12*b* is arranged at the top of the drying compartment 12, the second baffle covers the air outlet 12*b* from one side of the refrigeration compartment 13 and seals against the air outlet 12*b* under the action of gravity. When the air guiding device 40 is activated, the drying compartment 12 is in a positive pressure state, the third baffle is pushed open under the action of the air pressure, and the air flow in the drying compartment 12 enters into the refrigeration compartment 13 from the air outlet 12*b*. When the air guiding device 40 is closed, the air pressure in the drying compartment 12 gradually decreases, and the third baffle is gradually reset under the action of gravity. When the air pressure in the drying compartment 12 is less than the gravity of the third baffle, the third baffle firmly abuts against the air outlet 12*b*, so that moisture in the refrigeration compartment 13 cannot enter into the drying compartment 12 by the third baffle. The third baffle has a simple structure, which facilitates simplify the installation process.

It can be understood that, in the embodiment of the disclosure, the air guiding device 40 may be a device that can generate airflow, such as a fan, a blower, or an air pump.

In the embodiment, the refrigerator further includes a heating element 60 arranged in the drying compartment 12. The heating element 60 may be a resistance wire or a positive temperature coefficient (PTC) heater. In order to prevent the heating element 60 from greatly increasing the temperature in the refrigerator during operation, in the embodiment, the power of the heating element 60 should be less than 20 watts. Generally, the humidity decreases much faster than the temperature, so it is generally not necessary to activate the heating element 60 for active temperature control. However, in some special cases, for example, if the object having a high humidity and need to be cooled and air-dried is stored in the drying compartment 12, the object continuously emits moisture to the drying compartment 12, so that the humidity in the drying compartment 12 is kept high. At this time, due to the humidity in the drying compartment 12 does not meet the set requirement, the drying compartment 12 will continue to guide the cold air in the freezer compartment 11, so that the temperature in the drying compartment 12 is too low, which may frostbite other foods. In the present embodiment, by providing the heating member 60, the heating member 60 can be turned on when the above-mentioned condition occurs. The heating element 60 gradually increases the temperature in the drying compartment 12 during the low-power slow heating process, so that the temperature in the drying compartment 12 can be kept within a suitable temperature range, reducing the relative humidity in the drying compartment 12. Of course, it can be understood that the opening and closing of the heating element 60 can be controlled according to the temperature and humidity in the drying compartment 12.

A first embodiment of the disclosure will be described below with reference to FIG. 1 to FIG. 4.

Referring to FIG. 1 to FIG. 4, in the first embodiment of the disclosure, the air guiding device 40 is arranged in the drying compartment 12. In order to facilitate the installation of the air guiding device 40, the refrigerator further includes a second mounting seat 50 sandwiched between a side wall of the drying compartment 12 and the first mounting seat 21. A through aperture 50*a* is formed in the second mounting seat 50. The air intake channel passes through the through aperture. An inlet end of the through aperture 50*a* is hermetically connected with the air inlet 12*a*. An outlet end of the through aperture 50*a* is formed as the outlet of the air intake channel. The air guiding device 40 is arranged in the through aperture 50*a*. In an embodiment, a protuberance 51 is formed on a side of the second mounting seat 50 facing toward the first mounting seat 21 and extends into the first mounting seat 21, to improve the connection reliability of the first mounting seat 21 and the second mounting seat 50, and prevents relative slippage of the joint between the first mounting seat 21 and the second mounting seat 50. A plurality of first ribs 52 is formed inside the protuberance 51. The ends of the plurality of first ribs 52 form and surround a first supporting hole 52*a*. One end of the guide post 24 is slidably supported on the first supporting hole 52*a* or is fixedly embedded in the first supporting hole 52*a*.

A second embodiment of the disclosure will be described below with reference to FIG. 5 and FIG. 6.

Referring to FIG. 5 and FIG. 6, unlike the above described first embodiment, in the second embodiment of the disclosure, the air guiding device 40 is arranged in the through hole 101. The air inlet 12*a* of the drying compartment 12 is formed as the outlet of the air intake channel, and the end of the first mounting seat 21 directly and fixedly connected with the side wall of the drying compartment 12. Further, the air inlet 12*a* forms a plurality of second ribs 121. The plurality of second ribs 121 form and surround a second supporting hole 121*a*. One end of the guide post 24 is slidably supported on the second supporting hole 121*a* or is fixedly embedded in the second supporting hole 121*a*.

In the third embodiment not shown in the disclosure, the air guiding device is in the form of an air pump (not shown) which is arranged in the drying compartment 12. In one embodiment, an air inflow end of the air bump is hermetically connected with the air inlet 12*a* of the drying compartment 12, and an air outflow end of the air bump is formed as the outlet of the air intake channel. The cold air in the freezer compartment 11 enters the into drying compartment 12 through the through hole 101, the air inlet 12*a* and the air pump. Due to the air pump has a self-sealing structure so that effective gas quarantine can be carried out between the air inflow end and the air outflow end of the air pump. In the present embodiment, the first sealing device is formed as a self-sealing structure inside the air pump.

The above are only embodiments of the disclosure and not intended to limit the scope of protection of the disclosure.

What is claimed is:

1. A refrigerator, comprising:

a freezer compartment and a refrigeration compartment;

a drying compartment independently and hermetically arranged in the refrigeration compartment, the drying compartment being formed with an air inlet and an air outlet, wherein the air outlet is configured to enable communication between the drying compartment and the refrigeration compartment;

an air intake channel for communication between the freezer compartment and the drying compartment, the air intake channel passing through the air inlet;

a first sealing device arranged in the drying compartment, the first sealing device being configured to be switched between a state in which an outlet of the air intake channel is sealed by the first sealing device and a state in which the first sealing device keeps away from the outlet of the air intake channel;

a second sealing device arranged at the air outlet, the second sealing device being configured to be switched between a state in which the air outlet is sealed by the second sealing device and a state in which the second sealing device keeps away from the air outlet; and an air guider, the air guider being arranged on the air intake channel to guide the air in the freezer compartment to the drying compartment.

2. The refrigerator according to claim 1, wherein the first sealing device comprises a first baffle and a first elastic member, the first baffle being adapted to the outlet of the air intake channel, the first baffle covering the outlet of the air intake channel from one side of the drying compartment, and the first baffle being connected with the first elastic member to seal against the outlet of the air intake channel under an action of an elastic force of the first elastic member.

3. The refrigerator according to claim 2, wherein the first sealing device comprises a first mounting seat and a guide post located in the first mounting seat, a receiving chamber being formed inside the first mounting seat and having an opening facing toward the outlet of the air intake channel, the first baffle and the first elastic member being received in the receiving chamber, the first elastic member being sandwiched between the first mounting seat and a side of the first baffle away from the outlet of the air intake channel;

wherein the guide post is fixedly installed in the first mounting seat, and the first baffle being slidably connected with the first baffle; or the guide post is fixedly connected with the first baffle, the guide post and the first baffle being slidably in the first mounting seat.

4. The refrigerator according to claim 3, comprising a second mounting seat arranged in the drying compartment and sandwiched between a side wall of the drying compartment and the first mounting seat, a through aperture being formed in the second mounting seat, an inlet end of the through aperture being hermetically connected with the air inlet, an outlet end of the through aperture forming the outlet of the air intake channel, the air guider being arranged in the through aperture.

5. The refrigerator according to claim 4, wherein a protuberance is formed on a side of the second mounting seat facing toward the first mounting seat, the protuberance extending into the first mounting seat, a plurality of first ribs being formed inside the protuberance, ends of the plurality of first ribs forming and surrounding a first supporting hole, wherein both ends of the guide post are slidably supported on the first supporting hole and the first mounting seat; or the guide post is fixedly connected with at least one of the first supporting hole and the first mounting seat, the first baffle being slidably arranged around the guide post.

6. The refrigerator according to claim 3, wherein a partition is formed between the freezer compartment and the refrigeration compartment, the partition being formed with a through hole through which the air intake channel passes, the through hole being arranged corresponding to the air inlet, the air guider being arranged in the through hole.

7. The refrigerator according to claim 6, wherein: the outlet of the air intake channel is formed as the air inlet, a plurality of second ribs being formed at the air inlet, the ends of the plurality of second ribs forming and surrounding a second supporting hole, wherein the guide post is fixedly connected with at least one of the second supporting hole and first mounting seat, the first baffle being slidably arranged around the guide post; or both ends of the guide post are slidably supported in the second supporting hole and the first mounting seat, the first baffle being fixedly connected with the guide post.

8. The refrigerator according to claim 2, wherein the second sealing device comprises a second baffle and a second elastic member, the second baffle covering the air outlet from one side of the refrigeration compartment, the second baffle being connected with the second elastic member to seal against the air outlet under an action of an elastic force of the second elastic member.

9. The refrigerator according to claim 8, wherein the air outlet is formed at a top of the drying compartment, the second sealing device comprising a third baffle covering the air outlet from one side of the refrigeration compartment, the third baffle sealing against the air outlet under the action of gravity.

10. The refrigerator according to claim 1, wherein the air guider is formed as a fan, a blower or an air pump.

11. The refrigerator according to claim 1, wherein a partition is formed between the freezer compartment and the refrigeration compartment, the partition being formed with a through hole through which the air intake channel passes, the through hole being arranged corresponding to the air inlet, the air guider being formed as an air pump which is arranged in the drying compartment, and a first sealing device being formed as a self-sealing structure inside the air pump, an air inflow end of the air bump being hermetically connected with the air inlet.

12. The refrigerator according to claim 1, comprising a damper arranged at an inlet of the air intake channel, the damper being operatively associated with an air guider.

13. The refrigerator according to claim 1, further comprising a heater arranged in the drying compartment.

14. The refrigerator according to claim 13, wherein a heating power of the heater is less than 20 watts.

15. The refrigerator according to claim 14, wherein the heater is a resistance wire or a PTC heater.

* * * * *